US006109067A

United States Patent [19]

Shibuta

[11] Patent Number: 6,109,067

[45] Date of Patent: Aug. 29, 2000

[54] FLAT BED KNITTING MACHINE HAVING A TRANSFER MECHANISM AND A TRANSFERRING METHOD THEREBY

[75] Inventor: Takekazu Shibuta, Tajiri, Japan

[73] Assignee: Shima Seiki Manufacturing, Ltd., Wakayama, Japan

[21] Appl. No.: 09/306,456

[22] Filed: May 6, 1999

[30] Foreign Application Priority Data

May 7, 1998 [JP] Japan ..... 10-124685

[51] Int. Cl.[7] ..... D04B 7/00

[52] U.S. Cl. ..... 66/64; 66/148

[58] Field of Search ..... 66/60 R, 64, 61, 66/66, 69, 120, 148, 147

[56] References Cited

U.S. PATENT DOCUMENTS 5,398,527 3/1995 Hirai et al. ..... 66/148

5,469,717 11/1995 Shibuta et al. ..... 66/64

5,992,184 11/1999 Shibuta ..... 66/64

*Primary Examiner*—Danny Worrell

*Attorney, Agent, or Firm*—Arent Fox Kintner Plotkin & Kahn, PLLC

[57] ABSTRACT

When a stitch loop is transferred from a transfer jack of an upper needle bed to a needle of a lower needle bed, strains on the stitch loop are reduced and stitch drop is prevented.

When transfer is made from the transfer jack to the needle, first a hook rear of the needle is advanced into the stitch loop. At this time, the transfer jack is retracted in relation to the hook. Next a hook face of the needle is advanced into the stitch loop, and at this time, the stitch loop is advanced towards the hook.

3 Claims, 7 Drawing Sheets

Prior Art

FLAT BED KNITTING MACHINE HAVING A TRANSFER MECHANISM AND A TRANSFERRING METHOD THEREBY

FIELD OF THE INVENTION

The present invention relates to a flat bed knitting machine wherein an upper auxiliary bed having transfer members is provided on at least one needle bed of a pair of lower needle beds, one in the front and the other in the rear. In particular, the present invention relates to a flat bed knitting machine that can reliably make a needle advance into a stitch loop when transferring is made from an upper auxiliary bed to a lower needle bed, and a transferring method thereby.

PRIOR ART

In a kind of flat bed knitting machines, to hold needles in needle grooves so that needles can be advanced and retracted freely, a pair of lower needle beds having needle grooves in the top thereof are arranged to oppose each other, one in the front and the other in the rear, and an upper bed is provided on at least one of these lower needle beds. A transfer member such as a transferjack or a needle having a transfer wing is slidably held in each groove of the upper bed. A stitch loop can be transferred between the pair of lower needle beds or between a lower needle bed and an upper bed. Such a flat bed knitting machine has been disclosed in Japanese Provisional Patent Sho 63-256752.

In the flat bed knitting machine disclosed therein, a stitch loop formed by needles of a lower needle bed is transferred onto a transfer member of an upper bed, then the front and rear needle beds are racked in the longitudinal direction. Next, the stitch loop held on the transfer jack is transferred onto a needle of the lower needle bed. As a result, the stitch loop is transferred onto a needle other than the needle that originally held the stitch loop.

In this flat bed knitting machine, when a stitch loop held on a needle is to be transferred onto a transfer member of an upper bed, the needle is made to rise and the stitch loop is pressed to open wider by transfer wings provided on sides of the needle. A loop holder of the transfer member is made to advance into this stitch loop, then the needle is lowered. As a result, the stitch loop will be transferred from the needle onto the transfer member. On the other hand, when transferring is to be made from a transfer member of an upper bed onto a needle of a lower needle bed, a hook of the needle is made to advance into the stitch loop held on the transfer member being kept in an advanced position. Then the transfer member is made to retreat.

In the flat bed knitting machine of Japanese Provisional Patent Sho 63-256752, when seen from a side, at the time of transferring, the transfer member is in a low position in which the transfer member overlaps with a sinker plate provided at the top end of the needle bed. The flat bed knitting machine is provided with a mechanism for retracting the upper bed, at the time of racking, into a position wherein the upper bed will not interfere with the sinker plate. Provision of such a retracting mechanism, however, makes the entire mechanism more complex. Moreover, as the upper bed is withdrawn upward while the stitch loop is held on the transfer member, it may cause troubles such as stretching and breakage of a stitch loop. In particular, when knitting is made on a knitting machine of a finer gauge or when finer stitch loops are knitted with a higher stitch density, the space for advancement of a needle is narrowed down, posing more difficult conditions.

After transfer from a needle onto a transfer member of an upper bed, when a transferred stitch loop is racked sidewise, the stitch loop 201 held on the transfer member will be tilted sidewise as shown in FIG. 9. To receive the stitch loop 201 onto the hook of the needle 205 from the transfer member 203, the needle 205 must reliably advance between a pair of loop holders 207*a*, 207*b* of the transfer member 203 and into the loop 201 held on these loop holders. To make the needle 205 reliably advance into the stitch loop 201, it is sufficient to give a large space between a loop top 201*a* and a loop bottom 201*b* on the transfer member 203. However, if the stitch loop 201 is made larger by increasing the thickness H of the loop holders of the transfer member 203, when the stitch density is increased to knit finer stitch loops, stitch loop 201 will be stretched. This will strain yarn and yarn may break. In other words, when the needle 205 is to be advanced into the stitch loop 201, it is hard to give a margin in timing and prevent stretching of the stitch loop 201 by adjusting the thickness H of the loop holders.

SUMMARY OF THE INVENTION

One objects of the present invention is to provide a flat bed knitting machine that can transfer a stitch loop favorably without giving any excessive strain to the stitch loop when the stitch loop is to be transferred by advancing a hook of a needle of a lower needle bed into the stitch loop held on loop holders of a transfer jack, a needle, etc. provided on an upper bed, and a transferring method thereby.

In the flat bed knitting machine according to the present invention, a large number of needles having a hook rear and a hook face are held on each of a first lower needle bed and a second lower needle bed in such a way that these needles can be advanced and retracted, the first needle bed and the second needle bed are arranged to oppose each other with a trick gap between them, the center line of said trick gap is defined as the trick gap center line, said first lower needle bed and said second lower needle bed can be racked relatively to each other, and an upper bed holding a large number of transfer members is provided in such a way that they can be advanced and retracted over at least one of the first and second lower needle beds.

The flat bed knitting machine according to the present invention is characterized in that to transfer a stitch loop held on a transfer member of the upper bed to a receiving needle of the first lower needle bed, the flat bed knitting machine is further provided with

- a transfer member control means for shifting first the transfer member away from the receiving needle and then advancing the transfer member towards the receiving needle, and
- a needle control means for advancing the receiving needle towards the transfer member upon or after start of the advancement of said transfer member towards the receiving needle.

Preferably, the flat bed knitting machine according to the present invention is further characterized in

- that said transfer member control means has a transfer member control cam reciprocating over the upper bed,
- that said transfer member control cam comprises a first cam means for advancing first the stitch loop held on said transfer member to a position beyond the trick gap center line and then retracting the stitch loop, and a second cam means for positioning first the stitch loop held on said transfer member in a position short of the trick gap center line and then advancing the stitch loop, and that said needle control means has a means for, in association with said first cam means, advancing the hook rear of said receiving needle to a position where the hook rear is in the stitch loop when said stitch loop is in a position beyond the trick gap center line and advancing the hook face of said receiving needle into the stitch loop when the stitch loop is retracted, and a means for, in association with said second cam means, advancing the hook rear of said receiving needle to a position where the hook rear is in the stitch loop when said stitch loop is retracted to a position short of the trick gap center line and advancing the hook face of said receiving needle into the stitch loop when the stitch loop is retracted.

Further, preferably, said first cam means and said second cam means comprise a single continuous cam groove formed in the transfer member control cam.

The transferring method using the flat bed knitting machine according to the present invention is characterized in that when transferring is made from a transfer member of an upper bed holding a stitch loop to a receiving needle of a lower needle bed, a hook rear of the needle is advanced into the stitch loop, and corresponding to this, the transfer member is shifted to shift the stitch loop onto a hook rear of the needle, and next, the hook face of the needle is advanced into the stitch loop, and corresponding to this, the transfer member is shifted to shift the stitch loop onto the hook face.

In the present invention, when transferring is made from a transfer member of an upper bed onto a needle of a lower needle bed, a stitch loop held on the transfer member is shifted to the hook rear side of the needle or side more distant from the needle and the hook rear is advanced into the stitch loop. When the hook rear is advanced into the stitch loop, the transfer member is shifted in the reverse direction, namely, to the hook face side of the needle, then the needle is advanced further to advance the hook face into the stitch loop. The first step of shifting the stitch loop towards the hook rear makes it easier for the hook rear to advance into the stitch loop. Next, the step of shifting the stitch loop towards the needle (towards the hook face) makes it easier for the stitch loop to go beyond the hook face into the hook. In the present invention, transferring can be made reliably from a transfer member onto a needle of a lower needle bed and yarn is not strained.

EMBODIMENT

Figure 1:
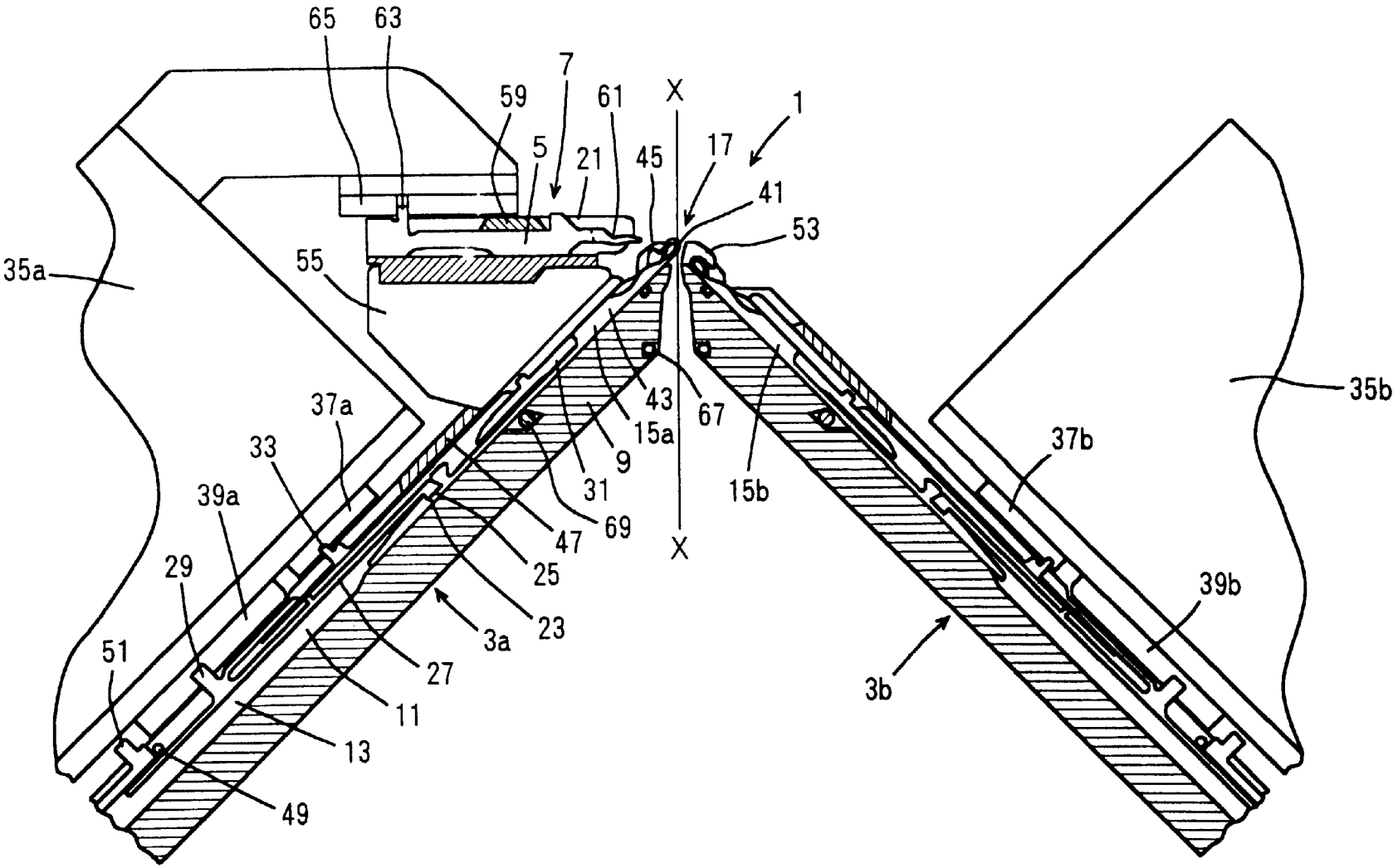
FIG. 1 is a vertical sectional view of an important part of a flat bed knitting machine of an embodiment.

A flat bed knitting machine having a transfer mechanism according to the present invention and a transfer method thereby will be described in detail with reference to the drawings. FIG. 1 is a vertical sectional view of an important part of the flat bed knitting machine of the embodiment. As shown in FIG. 1, the flat bed knitting machine 1 is provided with a pair of a lower needle bed 3*a* (front bed 3*a*) and a lower needle bed 3*b* (rear bed 3*b*) arranged to oppose to each other, one in the front and the other in the rear, and a transfer jack bed 7, an upper bed is arranged above the front bed 3*a*. The transfer jack bed 7 holds transfer jacks 5 being transfer members. The beds 3*a*, 3*b* are provided with plural grooves in the top of the respective bases 9. A needle plate 11 is set up in each of these grooves and a space between two adjacent needle plates 11, 11 is used as a needle groove 13. A needle 15 is held in each needle groove 13 in such a way that the needle can be moved towards and away from a trick gap 17 formed between the front and rear needle beds. The rear bed 3*b* can be shifted in its longitudinal direction by a driving means not illustrated (hereinafter this shift is referred to as racking).

The transfer jack bed 7 is provided with grooves 21 formed at the same pitch with the pitch of the needles of the front bed 3*a* and the rear bed 3*b*. Each of these grooves 21 holds a transferjack being a transfer member in such a way that the transfer jack 5 can be advanced and retracted, and the transfer jack bed 7 can be shifted sidewise relatively to the front bed 3*a* and the rear bed 3*b*. In the flat bed knitting machine 1 of the embodiment, transfer can be made between both the front and rear beds 3*a*, 3*b*, and between the transfer jack bed 7 and any one of both the front and rear beds 3*a*, 3*b*.

A concave 23 is formed in the rear end of the needle 15 held in the needle groove 13, and this concave 23 and a convex 25 provided on the needle jack 27 fit with each other. A pair of carriages 35*a*, 35*b*, one in the front and one in the rear, reciprocate sidewise over the needle beds. A butt 29 formed on the needle jack 27 and a butt 33 formed on the slider 31 are operated by cams 37*a*, 37*b*, 39*a*, 39*b* provided on these carriages 35*a*, 35*b* to effect knitting. Compound needles are used in this knitting. However, latch needles may be used.

The top end of the slider 31 is formed by overlapping two thin plates with each other. When the slider 31 is advanced towards a hook 41 of a needle 15*a* or 15*b*, the hook 41 will push and divide the slider 31 into two prongs, and a shoulder 45 of the slider 31 will hold a stitch loop to guide it into a transfer position. Each needle 15 is held in a needle groove 13 by a metal plate 47 fixed on a needle bed along the longitudinal direction thereof. The rear end of the needle jack 27 is elastically energized by the bottom of the needle groove 13 so that the butt 29 of the needle jack 27 is energized to come out of the needle groove 13. The needle jack 27 is held in the needle groove by a wire 49 mounted in the longitudinal direction of the needle bed. A select jack 51 is set above the needle jack 27, and when the select jack 51 is pressed by a presser mounted on the carriage 35*a* or 35*b* in such a way that the select jack 51 is sunk into the needle groove 13, the butt 29 of the needle jack 27 will not engage with the knitting cam 39*a* or 39*b* of the carriage 35*a* or 35*b* and be sunk into a rest position. In the trick gap 17 between both the front and rear needle beds, a sinker plate 53 is provided between needles.

Needle plates 11 set up on the front bed 3*a* are selected at fixed intervals to be extended upward and their extensions 55 are used as supports of the transfer jack bed 7. Transfer jacks 5 are held in respective grooves 21 of the transfer jack bed 7 and retained by a metal plate 59. The grooves 21 are set at the same pitch with those of the needle grooves 13 of both the front and rear beds 3*a*, 3*b*. A loop holder 61 is formed at the top end of the transfer jack 5, and an advancement/retraction control butt 63 is formed at the rear end thereof. When the butt 63 engages with a transfer jack cam 65 mounted on the carriage 35*a*, the transfer jack 5 will be advanced towards or retracted from the trick gap 17 located between both the front and rear needle beds. 67 denotes a wire mounted in the longitudinal direction of the needle bed to hold the sinker plate 53. 69 is a wire that fixes the base 9 and the needle plates 11 together.

Figure 2:
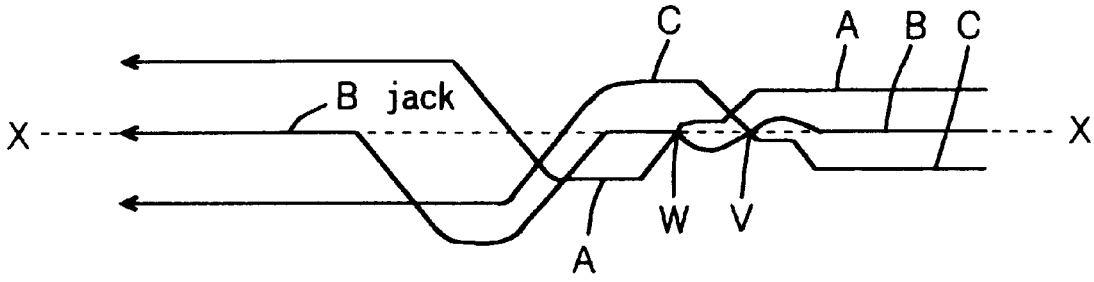
FIG. 2 shows tracks at the time of transfer from a transfer jack bed to a needle bed. Line A shows the track of a needle of a rear bed, line B shows the track of a transfer jack, and line C shows the track of a needle of a front bed.

With reference to FIG. 2, examples of tracks of the transfer jack 5 and needles 15*a*, 15*b* when transferring is made from the transfer jack bed 7 to the front bed 3*a* or the rear bed 3*b*, will be described. In FIG. 2, a chain line X—X indicates the position of the trick gear center line, and a line A indicates the track of the hook face of the needle 15*b* of the rear bed 3*b* when transfer is made from the transfer jack bed 7 to the rear bed 3*b*. A line B indicates the track of the loop holder 61 of the transfer jack 5 when transfer is made to the front bed 3*a* or the rear bed 3*b*. A line C is the track of the hook face of the needle 15*a* of the front bed 3*a* when transfer is made from the transfer jack bed 7 to the front bed 3*a*. An intersecting point V indicates the position at which the loop holder 61 of the transfer jack 5 and the hook face of the needle 15*a* intersect with each other. An intersecting point W indicates the position at which the line B and the hook face of the needle 15*b* intersect with each other. As clearly shown in FIG. 2, the position of the intersecting point V and that of W differ from each other in relation to the travel direction of the carriages.

As shown above, the transfer jack 5 advances and retracts in the same track when transfer is made to the front bed 3*a* and to the rear bed 3*b*. In contrast to this, the tracks of the needles that receive a stitch loop differ from each other, depending on whether the receiving needle belongs to the front bed or the rear bed. In FIG. 2, the needle of the front bed 3*a* advances at an earlier timing than the needle of the rear bed 3*b*.

In transfer to any one of the needle beds, the transfer jack 5 shifts away from the hook of the needle, and as a result of this, the loop holder of the transfer jack and the stitch loop will shift away from the hook and beyond the trick gap center line. In this stage, the hook rear (the bottom of the hook and the a part of the needle proper that starts to bend) will go beyond the bottom of the stitch loop and advances into the stitch loop. Next, the transferjack shits towards the hook, and the hook also advances towards the stitch loop. The hook face (a part of the hook that is in parallel to and above the needle proper) and the loop holder 61 of the transfer jack intersect with each other. When the hook advances further, the stitch loop will be transferred onto the hook.

Figure 3:
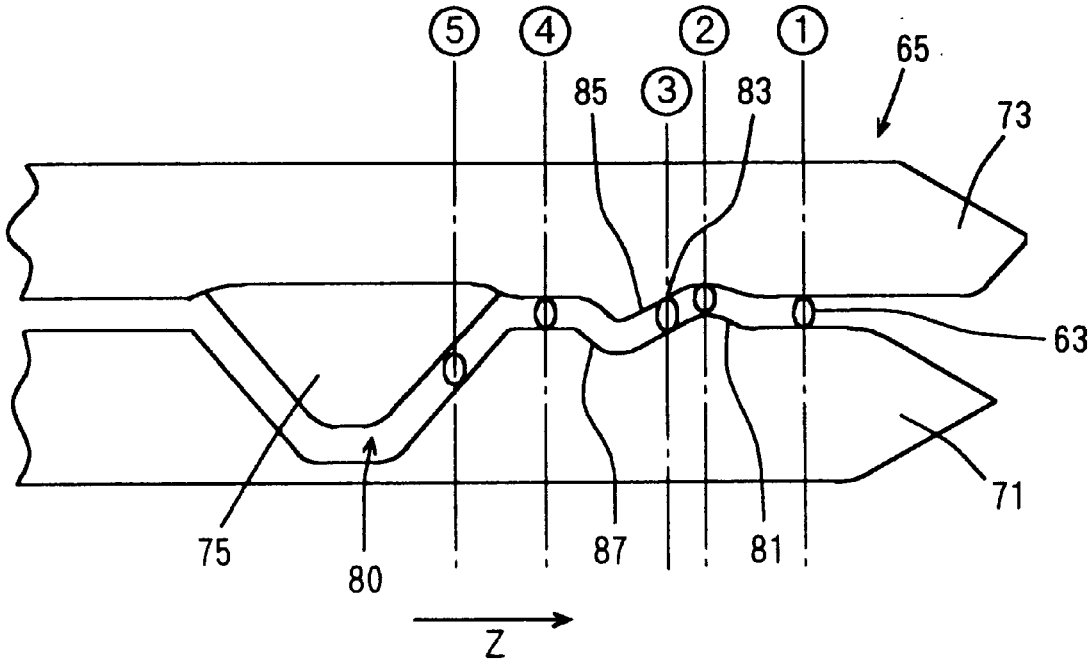
FIG. 3 is a bottom view of a transfer jack cam, showing cam operations at the time of transfer to a front bed.

With reference to FIG. 3, transfer from the transfer jack bed 7 to the front bed 3*a* will be described. The transfer jack cam 65 comprises a forward cam part 71 for advancing the transfer jack 5 towards the trick gap 17 located between the front and rear needle beds, a rear cam part 73 for retracting the transfer jack 5 from the trick gap 17, and a triangular movable cam 75. the forward cam part 71 contacts the rear of the butt 63, and the rear cam part 73 contacts the front of the butt 63. A route 80 for the butt 63 is provided between the front cam part 71 and the rear cam part 73 and between the movable cam 75 and the front cam part 71.

A cam surface 81 is formed on the front cam part 71, and this cam surface advances the stitch loop to a position just a little ahead the position of the trick gap center line X—X (intermediate position) when transfer is made from the transfer jack bed 7 to the front bed 3*a*. A cam surface 83 is formed on the rear cam part 73, and this cam surface serves to bring the stitch loop back to the trick gap center line X—X. The cam surface 81 and the cum surface 83 are provided continuously in the travel direction (indicated by an arrow Z) of the carriages, and they control the transfer jack 5 when transfer is made from the transfer jack bed 7 to the front bed 3*a*. Further, the rear cam part 73 is provided with a cam surface 85 for shifting the stitch loop to a position a little retracted from the trick gap center line X—X (retracted position). The forward cam part 71 is provided with a cam surface 87 for bringing the stitch loop that has been shifted to the retracted position back to the intermediate position. The cam surface 85 and the cam surface 87 are provided continuously in the direction of travel of the carriages, and they control the transfer jack 5 when transfer is made from the transfer jack bed 7 to the rear bed 3*b*. As described above, a pair of the cam surface 81 and the cam surface 83 and a pair of the cam surface 85 and the cam surface 87 are provided in different positions in the travel direction of the carriages. Although the cam surface 83 and the cam surface 85 are provided as a continuous one cam surface, or a continuous cam grrove in the present embodiment, it is not essential to provide them as a single cam surface or a groove.

Next, the operations of the flat bed knitting machine 1 of the embodiment and the transferring method thereby will be described. A unique feature of the present invention rests in the movements of a transferjack and a needle when transfer is made from a transfer jack bed to one of the pair of lower needle beds. Therefore, in the embodiment, a case of transferring in a course of transferring a stitch loop sidewise will be described, wherein a stitch loop is transferred from the front bed 3*a* or the rear bed 3*b* to the transfer jack bed 7, then the transfer jack bed 7 is racked, and then the stitch loop is transferred back to the front bed 3*a* or the rear bed 3*b*.

Figure 4:
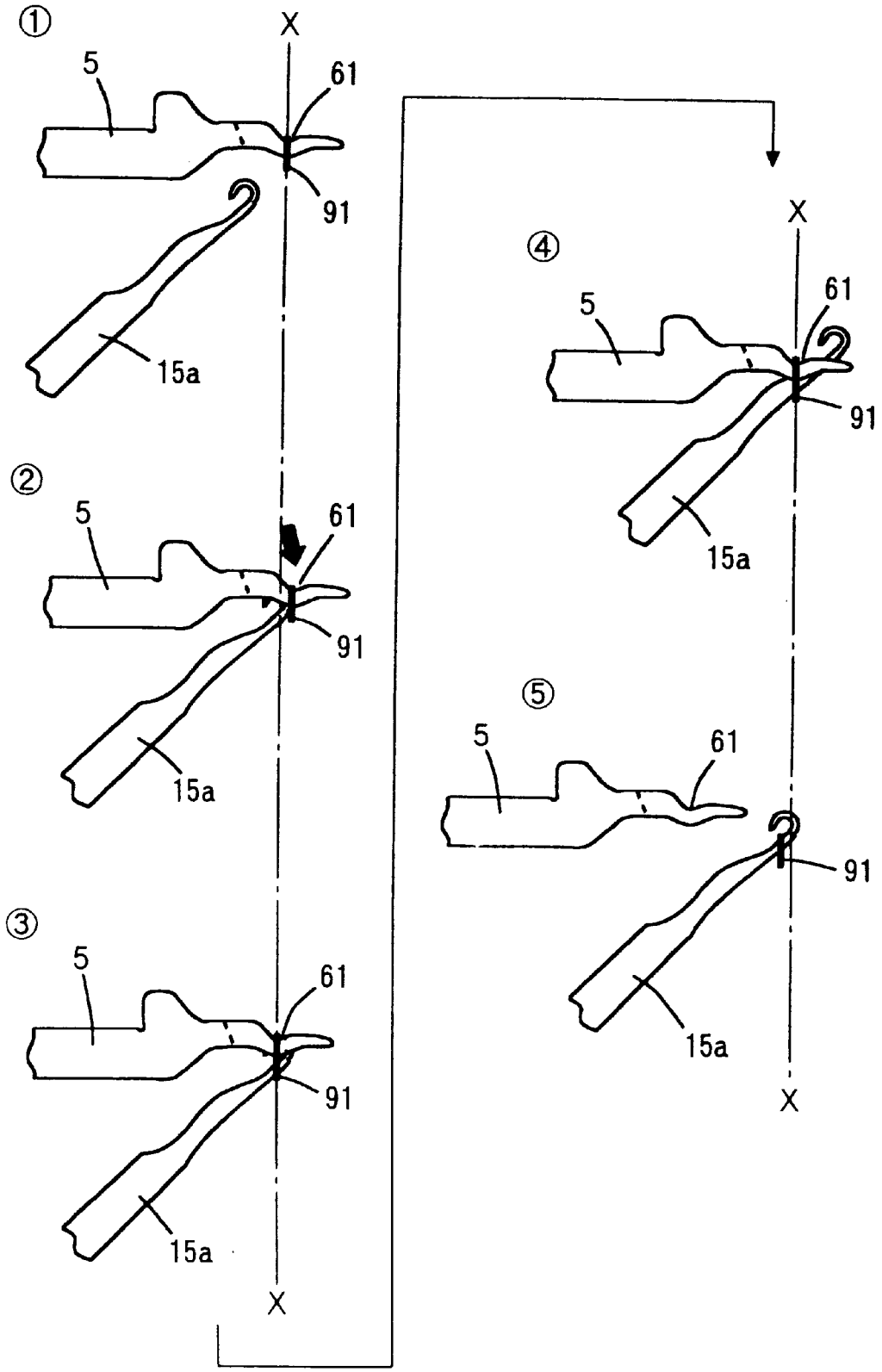
FIG. 4 shows transfer steps from the transfer jack bed to the front bed, and steps 1 through 5 correspond to positions 1 through 5 of FIG. 3, respectively.
Figure 5:
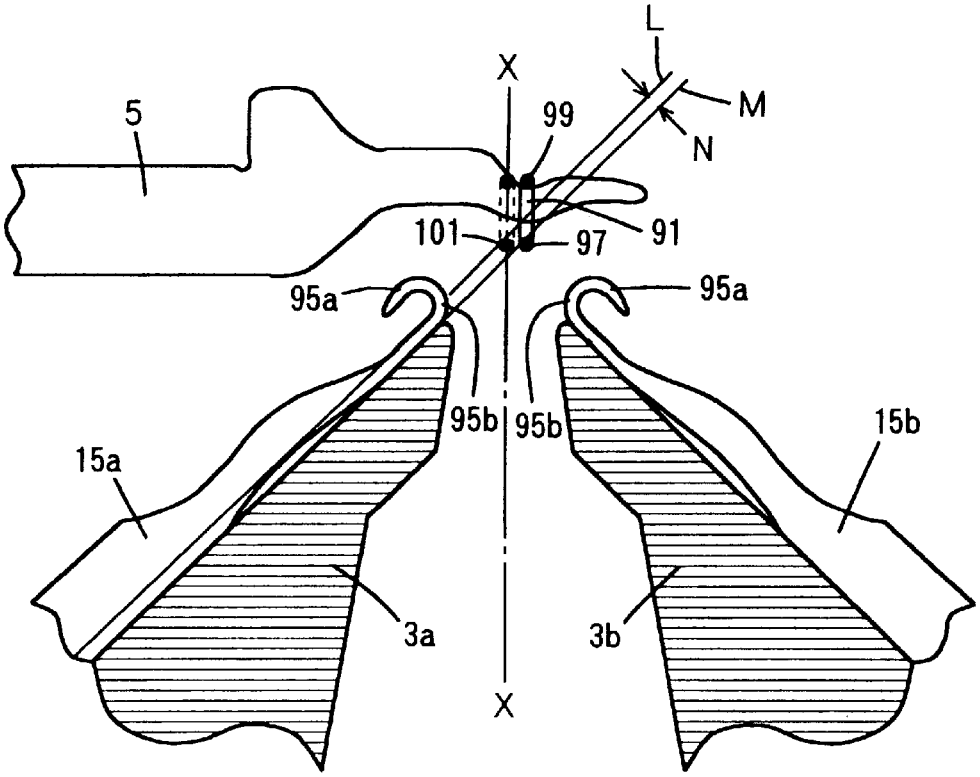
FIG. 5 shows transfer from the transfer jack bed to the front bed, indicating the positions of the stitch loop and the track of the needle of the front bed.

With reference to FIG. 3 through FIG. 5, transfer from the transfer jack bed 7 to the front bed 3*a* will be described. In the present embodiment, description of cams for the needles is omitted because the track of the needle 15 and the cam configuration for advancing and retracting the needle 15 in coordination with the movements of the transfer jack 5 may take various forms. FIG. 4 shows the transferjack 5 and the needle 15*a* of the front bed when the butt 53 is in the respective positions 1 through 5 of FIG. 3. FIG. 5 is a diagram in which the transfer jack 5 in the advanced position and the needle 15*a* in the lowered position 15*a* are schematically combined with each other. In FIG. 5, the stitch loop 91 in the advanced position is indicated by solid line, and the stitch loop 91 in the intermediate position is indicated by broken line.

The stitch loop 91 is held on the transfer jack 5, next the carriages 35*a*, 35*b* travel in the direction of arrow Z and the transfer jack 5 comes to the position 1 of FIG. 3. This state is shown in step 1 of FIG. 4. The transferjack 5 has advanced the stitch loop 91 to the intermediate position, and the needle 15*a* of the front bed 3*a* is standing by in the lowered position.

Next, when the carriages 35*a*, 35*b* travel further, in the position of 2 of FIG. 3, the transfer jack 5 will be advanced by the cam surface 81. As shown in the step 2 of FIG. 4, at this time the needle 15*a* starts to advance. At this time, the stitch loop 91 takes the advanced position that is a little beyond the trick gap center line X—X located between the front and rear needle beds. When the stitch loop 91 is in this position, the needle 15*a* advances towards the stitch loop 91.

Figure 9:
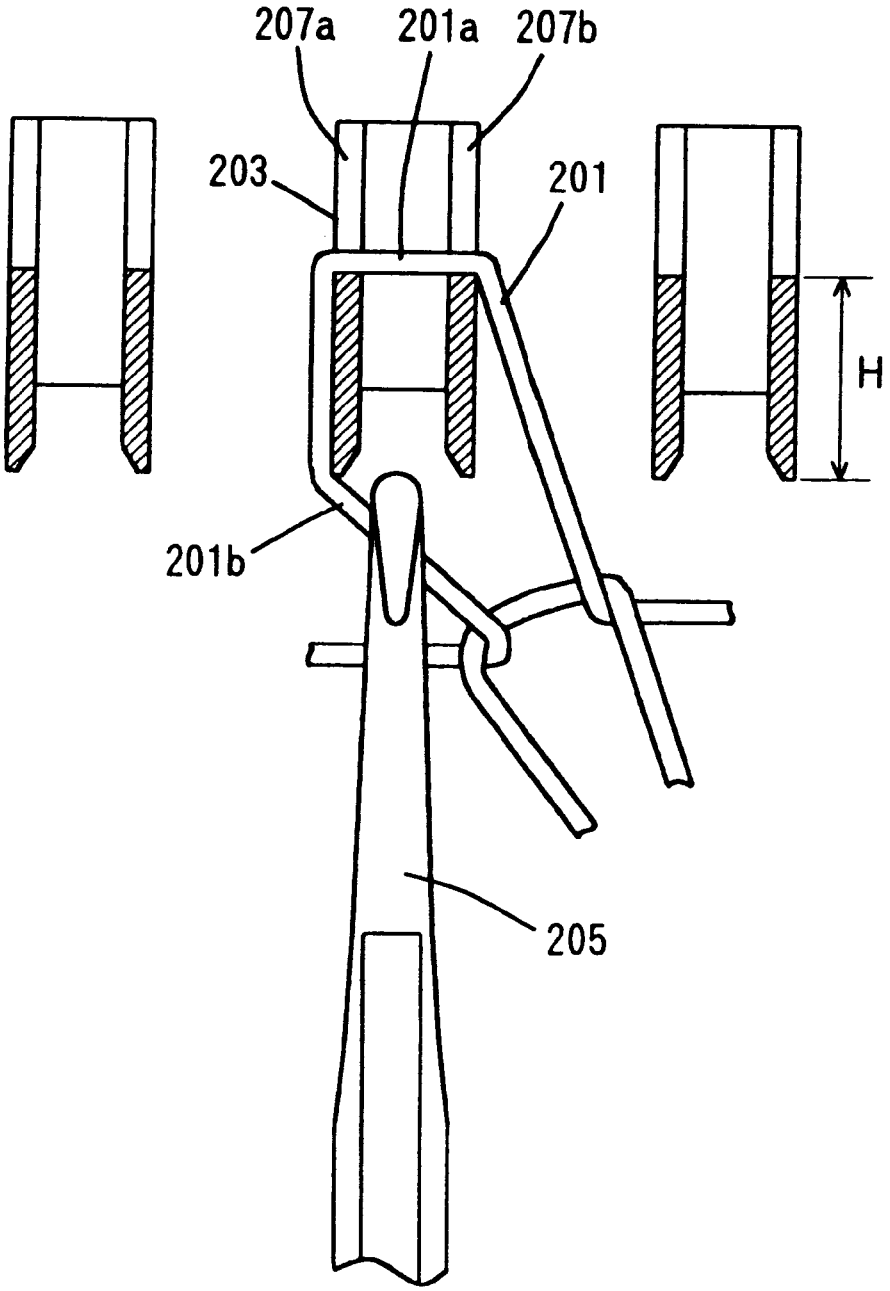
FIG. 9 is a partially-cut-away plan view showing transfer of prior art.

To explain the relationship between the transfer jack 5 and the stitch loop 91 in the step 2 of FIG. 4, a comparison will be made, using FIG. 5, with a conventional case wherein transfer is made when the stitch loop is located on the trick gap center line between the front and rear needle beds. As explained above in relation with FIG. 9, a needle that is to receive a stitch loop advances into the stitch loop held across loop holders of a transfer jack and receives the stitch loop. The smaller is the stitch loop to be formed, the narrower is the space for advancement of the needle, and in turn, the harder it is to receive the stitch loop. In other words, troubles will increase, such as when the receiving needle advances, the hook of the needle may push the loop, or the yarn may go beyond the hook surface and the needle can not catch the stitch loop.

If the stitch loop is positioned on the trick gap center line X—X in the conventional manner and the needle is advanced towards the stitch loop, the hook rear 95*b* of the needle 15*a* will move along a straight line L that is in parallel to the direction of advancement and retraction of the needle 15*a*. Under this condition, when the needle 15*a* advances towards the stitch loop 91, the hook rear 95*b* of the needle 15*a* will push the loop bottom 101 of the stitch loop 91. On the other hand, in the embodiment, as shown by solid line, the stitch loop 91 is in the advanced position that is a little beyond the trick gap center line X—X. The transfer jack 5 is advanced by the cam surface 81, and under this condition, the needle 15*a* advances towards the stitch loop 91. When the stitch loop 91 is in the advanced position, a straight line M is drawn on the loop bottom 97 and in parallel with the advancement/retraction track of the needle 15*a*. The straight line M and the straight line L are parallel to each other and the distance between them is N. In other words, the stitch loop 91 has been shifted towards the rear side of the needle 15*a* by the distance N. As a result, when the hook rear 95*b* of the needle advances into the stitch loop 91, there will be less chance for the hook rear 95*b* to push the stitch loop 91 or for the stitch loop 91 to slip into the face side of the needle 15*a*. Even if the hook rear 95*b* of the needle 15*a* contacts yam, the stitch loop 91 takes a position closer to the rear side of the needle 15*a* in comparison with the case in which the stitch loop 91 is located on the trick gap center line X—X. This means a higher chance for the stitch loop 91 to slip to the rear side of the needle 15*a*, and in turn, less chance of drop stitch.

Next, when the carriages 35*a*, 35*b* travel further and the transfer jack 5 comes to the position 3 of FIG. 3, the stitch loop 91 will be restored from the advanced position to the intermediate position located on the trick gap center line X—X as shown in the step 3 of FIG. 4. In the position 2 of FIG. 3, the transfer jack has been advanced by the cam surface 81, and as shown in FIG. 5, the loop top 99 held on the transfer jack 5 has been shifted towards the rear side of the needle 15*a* by a distance corresponding to the distance N between the straight line L and the straight line M. When the loop top 99 is shifted by a distance corresponding to the distance N, there is less chance for the hook face 95*a* to advance into the stitch loop 91 in comparison with a case when the stitch loop 91 is in the intermediate position. However, when the transfer jack 5 is retracted by the cam surface 83, the stitch loop 91 will be retracted onto the trick gap center line X—X and the stitch loop 91 will be shifted to the hook face side, and under this condition the needle 15*a* will advance. Accordingly, when the hook face 95*a* advances into the stitch loop 91, even if the hook face 95*a* contacts the stitch loop 91, the needle 15*a* can reliably advance into the stitch loop 91.

When the carriages 35*a*, 35*b* travel further and the transfer jack 5 comes to the position 4 of FIG. 3, the needle 15*a* will advance more, and as shown in the step 4 of FIG. 4, the stitch loop 9 will be held on a trunk of the needle 15*a*. After the transfer jack 5 reaches the position 5 of FIG. 3, the transfer jack 5 will be retracted by the movable cam 75, and the needle 15*a* will retract as well. Thus as shown in the step 5 of FIG. 4, transfer from the transfer jack 5 to the needle 15*a* of the front bed 3*a* is completed.

As described above, in the embodiment, when the hook rear 95*b* of the needle 15*a* is to advance into the stitch loop 91, if the transfer jack 5 is advanced and the stitch loop 91 is shifted to the rear side of the needle 15*a*, the hook rear 95*b* can easily advance into the stitch loop 91. Next, when the hook face 95*a* of the needle 15*a* is to advance into the stitch loop 91, if the transfer jack 5 is retracted and the stitch loop 91 is shifted to the face side of the needle 15*a*, the hook face 95*a* of the needle 15*a* can easily advance into the stitch loop 91.

Figure 6:
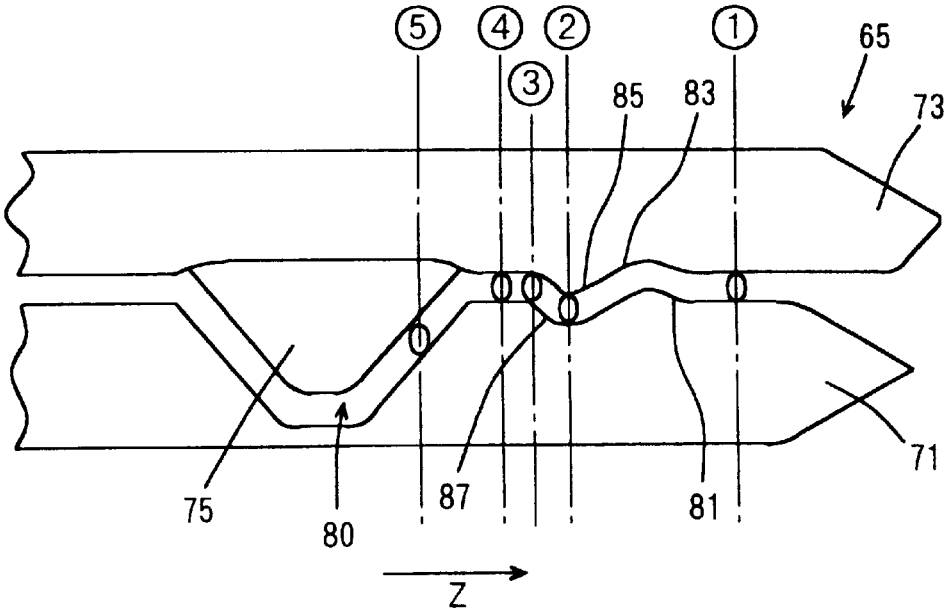
FIG. 6 is a bottom view of the transfer jack cam, showing cam operations at the time of transfer to a rear bed.
Figure 7:
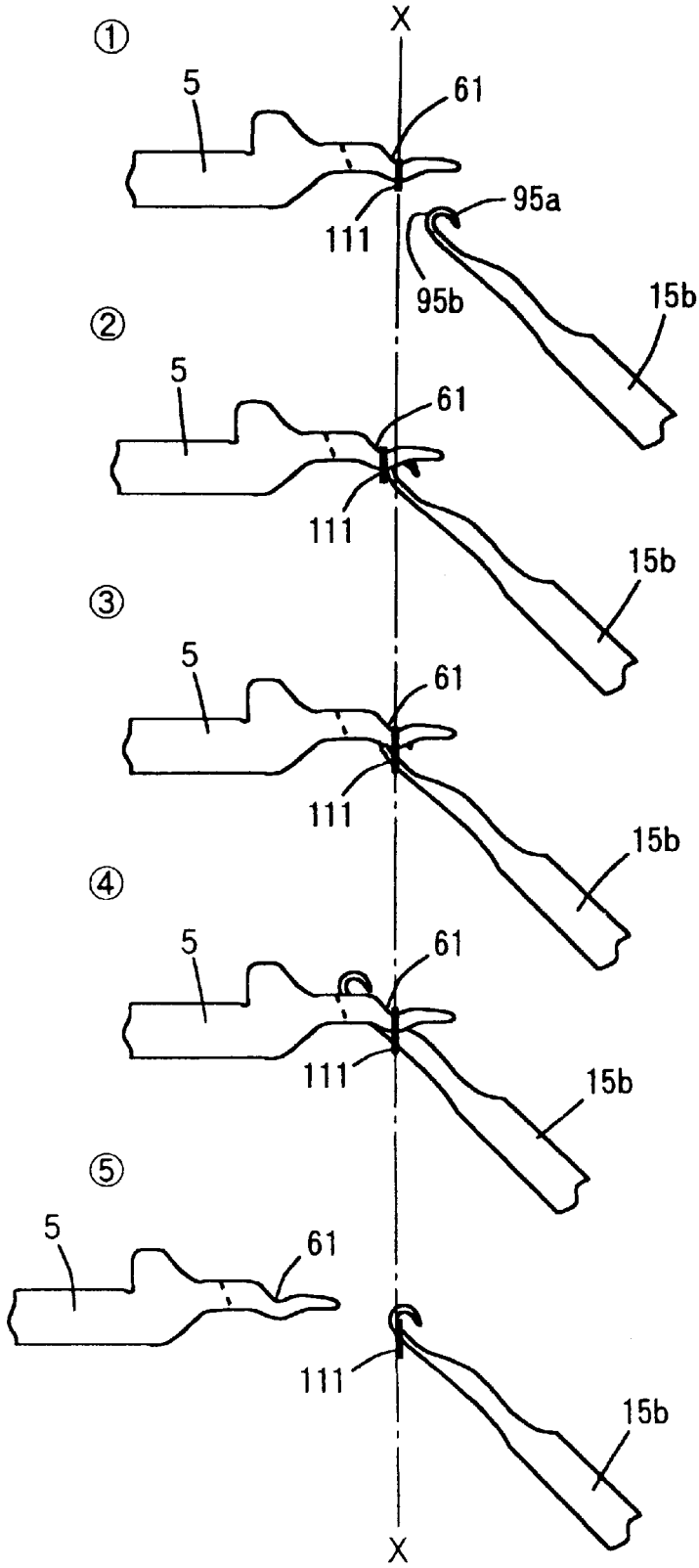
FIG. 7 shows transfer steps from the transfer jack bed to the rear bed.
Figure 8:
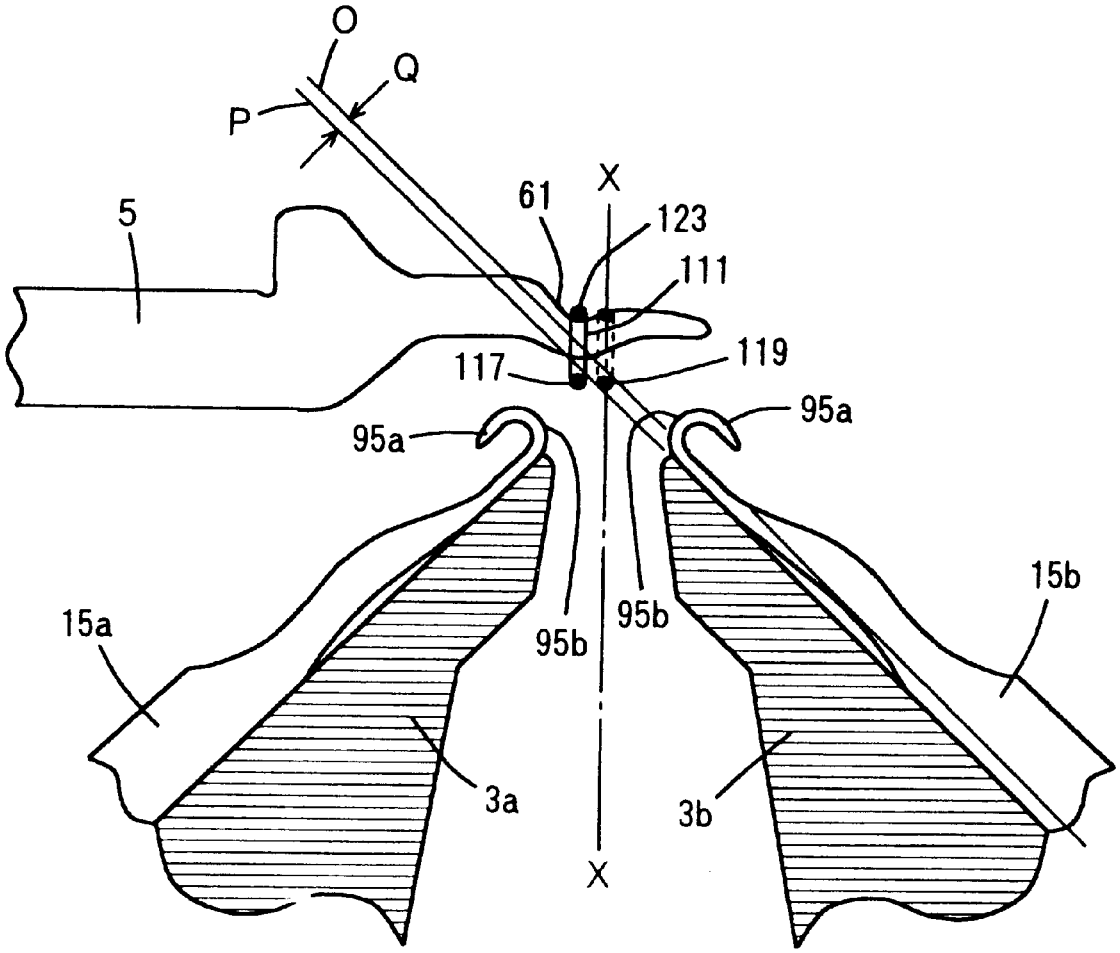
FIG. 8 shows transfer from the transfer jack bed to the rear bed, indicating the positions of the loop stitch and the track of the needle of the rear bed.

Next, with reference to FIG. 6 through FIG. 8, transfer from the transferjack bed 7 to the rear bed 3*b* will be described. FIG. 6 shows the track of the butt 63 of the transfer jack 5 at the time of transfer from the transfer jack bed 7 to a needle of the rear bed 3*b*. Steps 1 through 5 of FIG. 7 show the transfer jack 5 and the needle 15*b* when the butt 63 is in the respective positions 1 through 5 of FIG. 6. FIG. 8 shows the transfer jack 5 in the retracted position and the needle 15*b* in the lowered position. A stitch loop 111 is indicated by full line when it is in the retracted position and by broken line when it is in the intermediate position.

When the carriages 35*a*, 35*b* travel in the direction of an arrow Z in FIG. 6 and the transfer jack 5 reaches the position 1 of FIG. 6, the jack 5 will hold the stitch loop 111 and advances it to the intermediate position on the trick gap center line X—X as shown in the step 1 in FIG. 7. At this time, the needle 15*b* is standing by in the lowered position. Next, the carriages 35*a*, 35*b* travel and the transfer jack 5 reaches the position 2 of FIG. 6, the jack 5 will be retracted a little away from the center line X—X of the trick gap 17 by the cam surface 85 and shifted to the retracted position. Then, as shown in the step 2 of FIG. 7, the needle 15 of the rear bed 3*b* advances towards the retracted stitch loop 111. Transfer from this condition will be described with reference to FIG. 8 and in comparison with transfer in which the stitch loop 111 is positioned on the trick gap center line X—X.

In the embodiment, the transferjack 5 is retracted by the cam surface 85 to the retracted position, and as a result, the stitch loop 111 shifts to the side of the front bed 3*a* as shown in FIG. 8. Now, the stitch loop 111 is supposed to be on the trick gap center line X—X and a straight line O is drawn through the loop bottom 119 and in parallel with the advancement/retraction track of the rear bed 3*b*. On the other hand, the stitch loop 111 is supposed to be in the retracted position and a straight line P is drawn through the loop bottom 117 and in parallel with the advancement/retraction track of the needle of the rear bed 3*b*. When the needle 15*b* advances into the stitch loop 111 drawn by full line, the hook rear 95*b* of the needle 15*b* will advance into the stitch loop 111 which has been shifted to the rear side of the needle 15*b* by a distance corresponding to the distance Q of these straight lines O, P. Thus there is less chance for the needle 15*b* to push the stitch loop 11 or for the stitch loop 111 to come round to the face side of the needle 15*b*, resulting in a drop stitch.

When the transfer jack 5 reaches the position 4 of FIG. 6, the needle 15*b* advances further as shown in the step 4 of FIG. 7. After the transfer jack 5 reaches the position 5 of FIG. 6, the transfer jack 5 will be retracted by the movable cam 75, and the needle 15*b* will retract and transfer onto the needle 15*b* will be completed.

In the embodiment, the stitch loop is shifted to the hook rear side by the cam surface 81 or the cam surface 85. The stitch loop is restored onto the trick gap center line X—X by the cam surface 83 or the cam surface 87. However, it should be noted that cam surfaces 83, 87 do not have to be cams which restore a loop onto the trick gap center line X—X. It is sufficient for the cam surfaces 83, 87 to shift a stitch loop that has been shifted by the cam surface 81 or 85 in a direction opposite to the initial shift.

So far, an example of a flat bed knitting machine wherein the transfer jack bed 7 is provided only on the front bed 3*a* has been described. The present invention, however, is not limited to the embodiment. For example, it is possible to provide each of both the front and rear lower needle beds 3*a*, 3*b* with one transfer jack bed 7. Further, in the embodiment, the same cam 65 is used for transfer from the transfer jack 5 to the needle 15 as well as for transfer from the needle 15 to the transfer jack 5. In this case, however, the tracks of the needles 15*a*, 15*b* differ from those shown in FIG. 2, FIG. 4 and FIG. 7.

A needle guide may be, as shown in the embodiment, a mechanism wherein a butt formed on a needle, a transfer jack, etc. is operated by a cam, or a mechanism wherein an individual needle is advanced and retracted by a linear motor. Moreover, in the embodiment, a case using an upper bed having transfer jacks as transfer members has been described. Transfer members on the upper bed may be needles having a transfer blade.

What is claimed is:

1. A flat bed knitting machine wherein a large number of needles having a hook rear and a hook face are held on each of a first lower needle bed and a second lower needle bed in such a way that said needles can be advanced and retracted, the first needle bed and the second needle bed are arranged to oppose each other with a trick gap between them, said trick gap having a trick gap center line, said first lower needle bed and said second lower needle bed can be racked relatively to each other, and an upper bed holding a large number of transfer members is provided in such a way that said transfer members can be advanced and retracted over at least one of the first and second lower needle beds, characterized in that to transfer a stitch loop held on a transfer member of the upper bed to a receiving needle of one of the first and second lower needle beds, the flat knitting machine is further provided with a transfer member control means for shifting first the transfer member away from the receiving needle and then advancing the transfer member towards the receiving needle, said transfer member control means has a transfer member control cam reciprocating over the upper bed, said transfer member control cam comprises a first cam means for advancing first the stitch loop held on said transfer member to a position beyond the trick gap center line and then retracting the stitch loop and a second cam means for positioning first the stitch loop held on said transfer member in a position short of the trick gap center line and then advancing the stitch loop, and a needle control means for advancing the receiving needle towards the transfer member in synchronization with the advancement of said transfer member towards the receiving needle, said needle control means has a means for, in synchronization with said first cam means, advancing the hook rear of said receiving needle to a position where the hook rear is in the stitch loop when said stitch loop is in a position beyond the trick gap center line and advancing the hook face of said receiving needle into the stitch when the stitch loop is retracted, and a means for, in synchronization with said second cam means, advancing the hook rear of said receiving needle to a position where the hook rear is in the stitch loop when said stitch loop is retracted to a position short of the trick gap center line and advancing the hook face of said receiving needle into the stitch loop when the stitch loop is retracted.

2. A flat bed knitting machine of claim 1 characterized in that said first cam means and said second cam means comprise a single continuous cam groove formed in the transfer member control cam.

3. A transferring method using a flat bed knitting machine wherein a large number of needles having a hook rear and a hook face are held on each of a first lower needle bed and a second lower needle bed in such a way that these needles can be advanced and retracted, the first needle bed and the second needle bed are arranged to oppose each other with a trick gap between them, said trick gap having a trick gap center line, said first lower needle bed and said second lower needle bed can be racked relatively to each other, and an upper bed holding a large number of transfer members is provided in such a way that they can be advanced and retracted over at least one of the first and second lower needle beds, characterized in that when transferring is made from a transfer member of an upper bed holding a stitch loop to a receiving needle of one of the first and second needle beds, a hook rear of the receiving needle is advanced into the stitch loop, and corresponding to this, the transfer member is shifted to shift the stitch loop onto a hook rear of the needle, and next, the hook face of the needle is advanced into the stitch loop, and corresponding to this, the transfer member is shifted to shift the stitch loop onto the hook face.

* * * * *